US006074238A

United States Patent [19]

DeRoss et al.

[11] Patent Number: 6,074,238

[45] Date of Patent: Jun. 13, 2000

[54] ELECTRICAL TAP CONNECTOR WITH SPREADER MEANS

[75] Inventors: Robert DeRoss, Palm Harbor; Richard A. Young, St. Petersburg, both of Fla.

[73] Assignee: Molex Incorporated, Lisle, Ill.

[21] Appl. No.: 09/095,517

[22] Filed: May 15, 1998

[51] Int. Cl.[7] ..... H01R 4/24

[52] U.S. Cl. ..... 439/409; 439/467

[58] Field of Search ..... 439/409, 410, 439/411, 412, 414, 417, 419, 467, 658; 140/147

[56] References Cited

U.S. PATENT DOCUMENTS

| | | | |
|---|---|---|---|
| 4,076,365 | 2/1978 | Ross et al. | 439/467 |
| 4,480,889 | 11/1984 | Greenwood | 439/404 |
| 4,496,206 | 1/1985 | Markwardt et al. | 439/409 |
| 4,744,775 | 5/1988 | Pauza | 439/607 |
| 4,795,356 | 1/1989 | Pauza | 439/225 |
| 4,995,830 | 2/1991 | Eckhaus | 439/409 |
| 5,080,606 | 1/1992 | Burkard | 439/403 |
| 5,120,246 | 6/1992 | Knox | 439/402 |
| 5,906,503 | 5/1999 | Wiencek et al. | 439/418 |
| 5,961,341 | 10/1999 | Knowles et al. | 439/403 |

*Primary Examiner*—Michael L. Gellner
*Assistant Examiner*—Barry M. L. Standig
*Attorney, Agent, or Firm*—Stephen Z. Weiss

[57] ABSTRACT

A tap connector is provided for interconnection to an electrical cable having a plurality of conductor wires. A base defines a longitudinal axis along which the electrical cable is disposed. A plurality of terminals are mounted on the base and are spaced laterally of the axis for terminating the conductor wires. A cover is pivotally mounted on the base and includes a spreader structure for engaging and spreading the conductor wires automatically in response to mounting the cover on the base.

18 Claims, 7 Drawing Sheets

ELECTRICAL TAP CONNECTOR WITH SPREADER MEANS

FIELD OF THE INVENTION

This invention generally relates to the art of electrical connectors and, particularly, to an electrical tap connector for interconnection to an electrical cable having a plurality of conductor wires.

BACKGROUND OF THE INVENTION

Electrical connectors are used in a wide variety of applications for terminating discrete electrical wires. For instance, an electrical connector is used to terminate the conductor wires of a multi-conductor electrical cable.

Such electrical connectors often are used simply to terminate the ends of the conductor wires so that the wires can be interconnected to the terminals of a complementary mating connector device. On the other hand, connectors are used to terminate the conductor wires "in-line", i.e. between opposite ends of one or more conductor wires. These latter types of connectors commonly are called tap connectors. Still other connectors interconnect adjacent ends of a pair of conductor wires, for instance, and these types of connectors commonly are called splice connectors. In the art, the term "tap" connector often has been used to designate both tap connectors and splice connectors as described above, and that term will be used herein with such an understanding.

Tap connectors often are used for interconnection to an electrical cable having a plurality of conductor wires. One of the problems with such usage is that the wires are closely spaced within the cable and must be spread apart for termination in the tap connector. This is particularly true when the tap connector includes insulation displacement terminals for termination to insulated conductor wires of the electrical cable. Separating and spreading the conductor wires of the cable often is done by hand which is very tedious and not very cost effective. Another problem is maintaining the discrete conductor wires generally parallel to each other during termination. This latter problem is particularly prevalent with insulation displacement terminations.

The present invention is directed to solving the above problems and satisfying a need for a very simple and inexpensive tap connector of the character described.

SUMMARY OF THE INVENTION

An object, therefore, of the invention is to provide a new and improved tap connector for interconnection to an electrical cable having a plurality of conductor wires.

As disclosed herein, the tap connector is adapted for terminating insulated conductor wires of the electrical cable. However, the invention is not limited for use with insulated wires.

With that understanding, in the exemplary embodiment of the invention, the tap connector includes a base housing part defining a longitudinal axis along which the electrical cable is disposed. A plurality of insulation displacement terminals are mounted on the base housing part and are spaced laterally of the longitudinal axis for terminating the insulated conductor wires of the cable. A cover housing part is pivotally mounted on the base housing part for movement between an open position and a closed position whereat the insulated conductor wires are biased into termination with the insulation displacement terminals. Spreader means are provided on the cover housing part for engaging the conductor wires and spreading the wires into alignment with the laterally spaced terminals. The wires, thereby, are automatically spread in response to pivoting the cover housing part from its open position to its closed position.

According to one aspect of the invention, the spreader means includes an angled surface for engaging and biasing one of the conductor wires away from another of the conductor wires in response to pivoting the cover housing part to its closed position. Preferably, the spreader means includes a pair of the angled surfaces at opposite angles to bias a pair of the conductor wires away from each other. Locating means are provided between the pair of angled surfaces for holding a third conductor wire between the pair of conductor wires.

According to another aspect of the invention, a pair of the spreader means are spaced longitudinally on opposite sides of the insulation displacement terminals. Therefore, the spaced spreader means maintain the conductor wires generally parallel to the longitudinal axis in the area of the terminals.

Still further, the base housing part includes a receptacle for a complementary mating connector. The terminals have contact portions in the receptacle for engaging appropriate contacts of the mating connector. The receptacle faces generally perpendicular to the longitudinal axis whereby the tap connector has a right-angled configuration.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
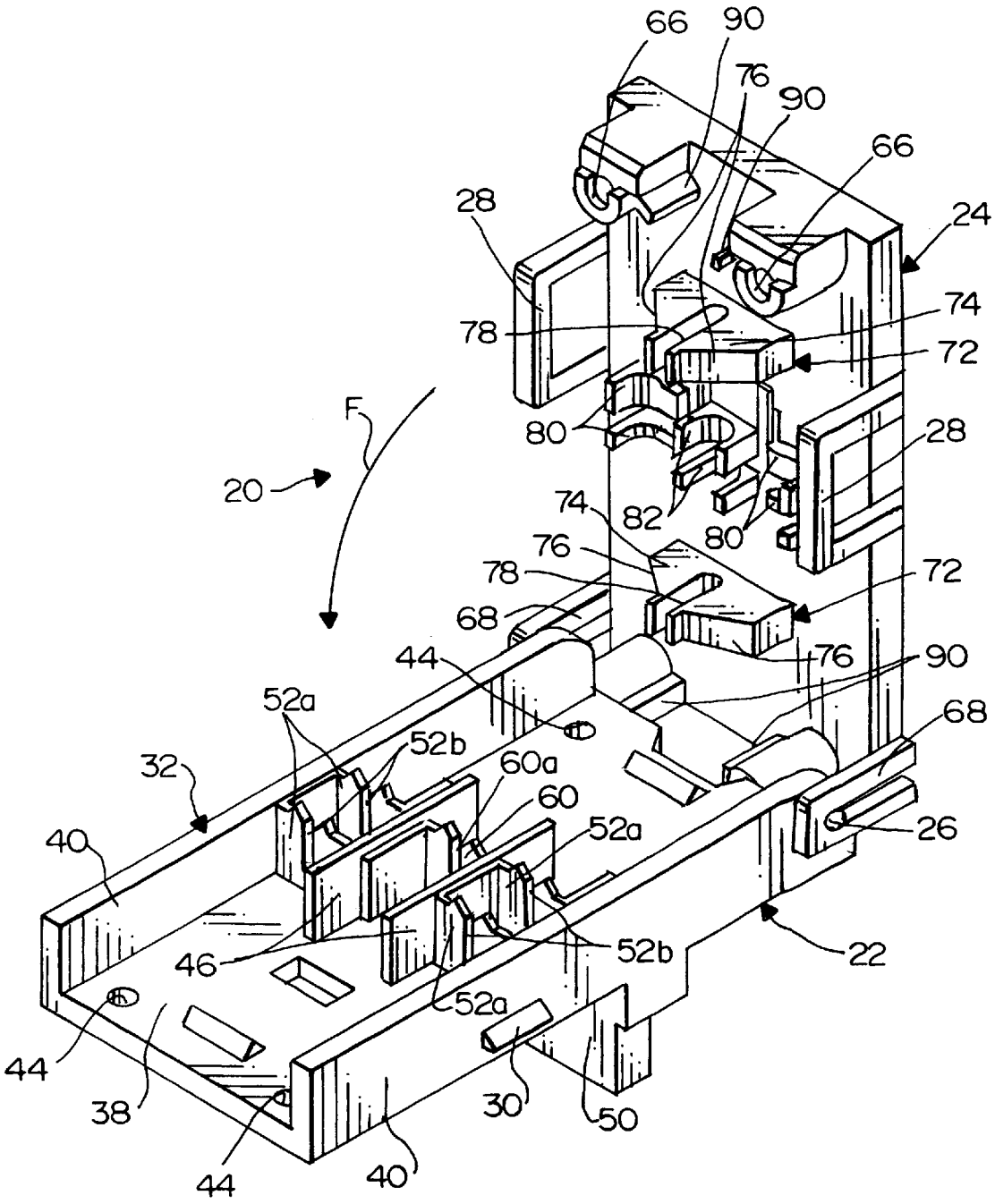
FIG. 1 is a perspective view of the tap connector, with the cover in open position.
Figure 2:
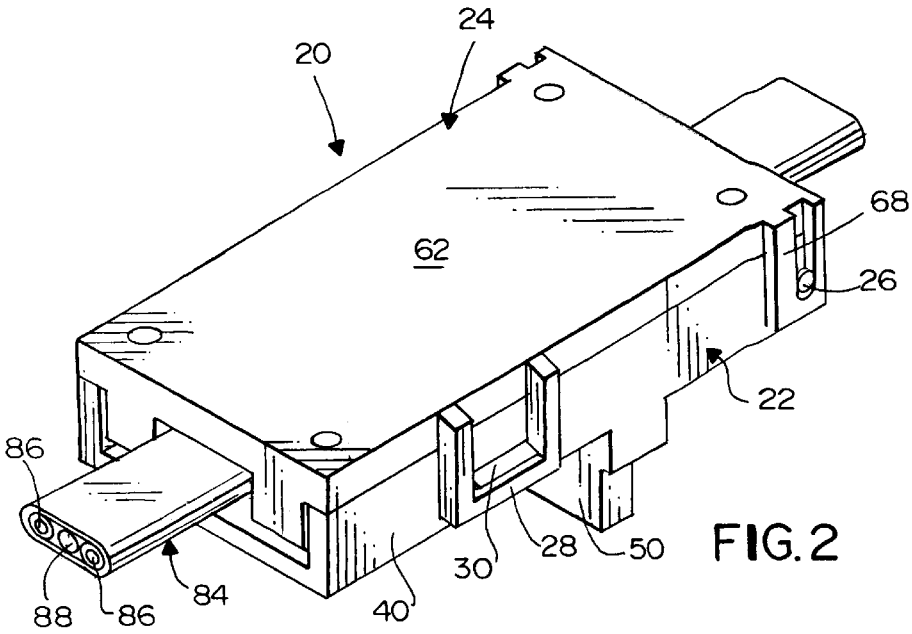
FIG. 2 is a perspective view similar to that of FIG. 1, with the cover in closed position.
Figure 6:
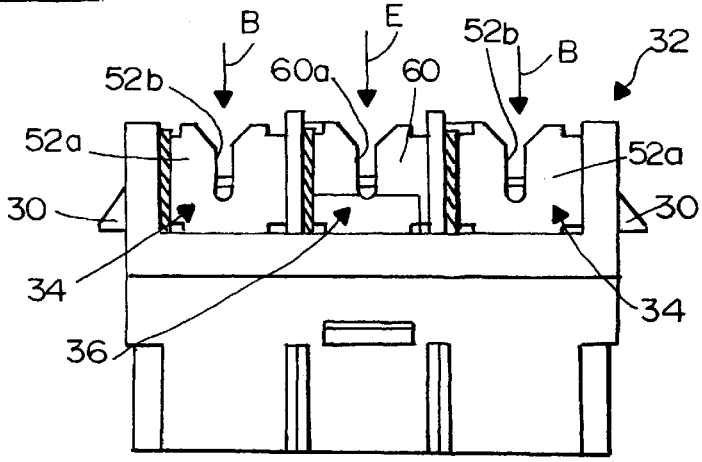
FIG. 6 is an end elevational view of the base assembly looking toward the left-hand end of FIG. 4.

Referring to the drawings in greater detail, and first to FIGS. 1 and 2, the invention is embodied in a tap connector, generally designated 20, for interconnection to an electrical cable 84 having a plurality of conductor wires 86 and 88. Generally, tap connector 20 includes a two-part housing comprised of a base housing part or base, generally designated 22, and a cover housing part or cover, generally designated 24. The cover is mounted on the base for pivotal movement about a pivot point 26 from an open position shown in FIG. 1 to a closed position shown in FIG. 2. The cover has a pair of U-shaped side latch arms 28 for snappingly engaging a pair of side latch bosses 30 on the base to hold the cover in its closed position. Latch arms 28 are flexible and latch bosses 30 are chamfered as seen in FIG. 6 to facilitate snapping the latch arms over the latch bosses. Each of the base 22 and the cover 24 is a one-piece structure unitarily molded of dielectric material such as plastic or the like.

FIGS. 3–6 show a base assembly, generally designated 32, which includes base 22, a pair of outside or laterally spaced power terminals, generally designated 34, and a center ground terminal, generally designated 36. Base 22 includes a bottom wall 38 and a pair of side walls 40. Latch bosses 30 project outwardly of the side walls. A pair of pivot bosses 42 also project outwardly from the side walls for pivotally mounting cover 24, as described hereinafter. Four holes 44 are formed through bottom wall 38 for receiving appropriate fasteners as described hereinafter. A pair of upstanding walls 46 project upwardly of bottom wall 38 between terminals 34 and 36 to separate and insulate the terminals.

Figure 3:
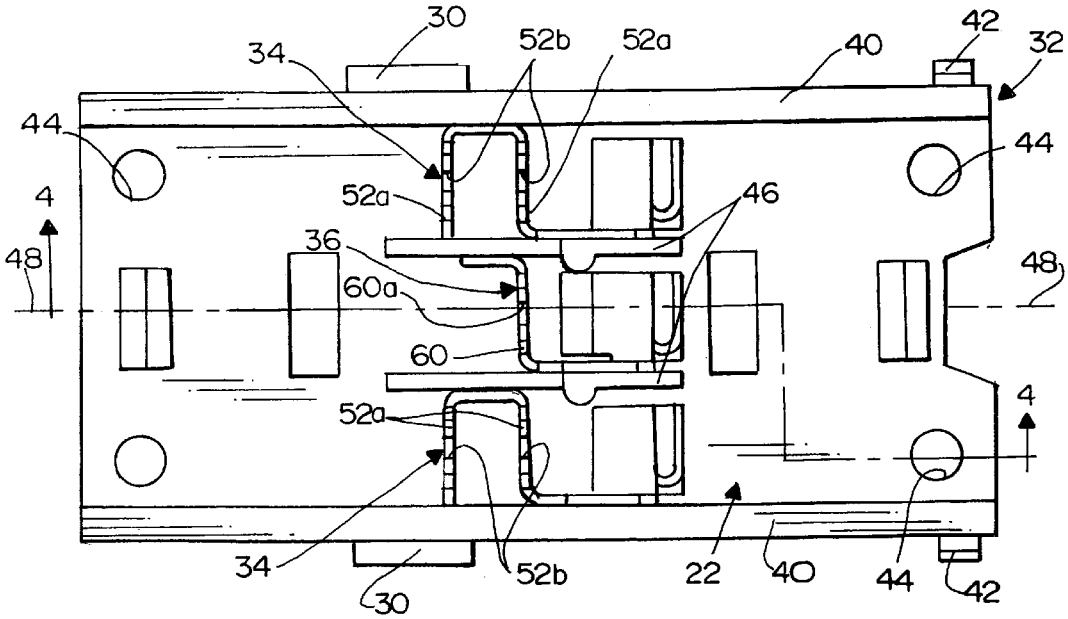
FIG. 3 is a top plan view of the base assembly, including the base and the terminals.
Figure 4:
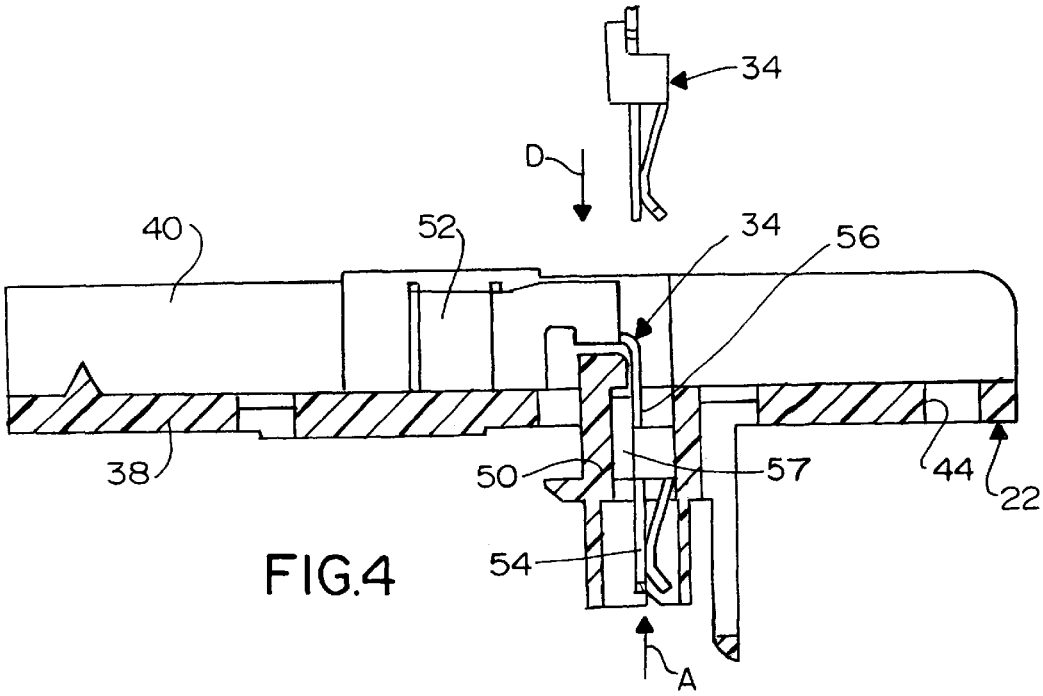
FIG. 4 is a vertical section taken generally along line 4—4 of FIG. 3.

Generally, tap connector 20 is adapted for mating with a complementary mating connector in a direction generally perpendicular to the electrical cable which is terminated by the tap connector. More particularly, base assembly 32 defines a longitudinal axis 48 (FIG. 3) along which the electrical cable is disposed. As seen in FIG. 4, base 22 includes a receptacle 50 projecting from bottom wall 38. The mating connector is mated to the receptacle in the direction of arrow "A" (FIG. 4). Therefore, the tap connector is provided with a right-angled configuration, whereby the mating connector is mated to the tap connector perpendicular to the electrical cable running through the tap connector.

Base assembly 32 is a self-contained assembly including base 38 and terminals 34 and 36. This assembly can be packaged and shipped along with cover 24 to an appropriate site whereat an operator can terminate the tap connector to the electrical cable, as described hereinafter.

Figure 7:
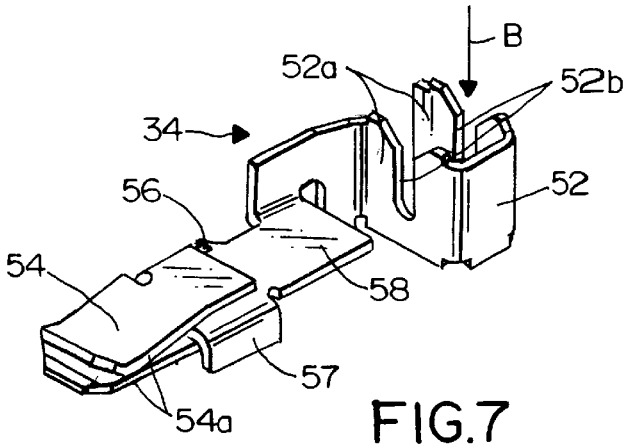
FIG. 7 is a perspective view of one of the power terminals, prior to being bent into its right-angled configuration.
Figure 8:
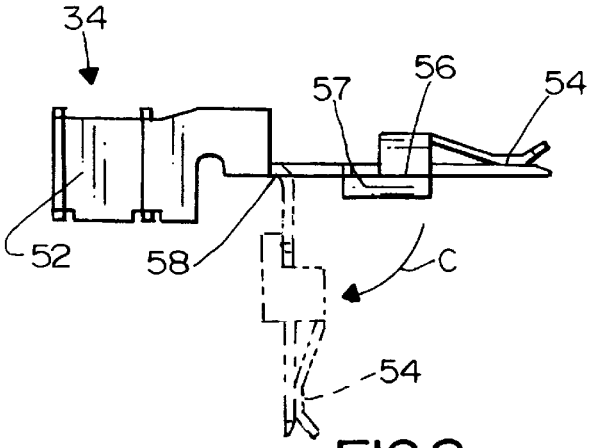
FIG. 8 is a side elevational view of the power terminal being bent.
Figure 9:
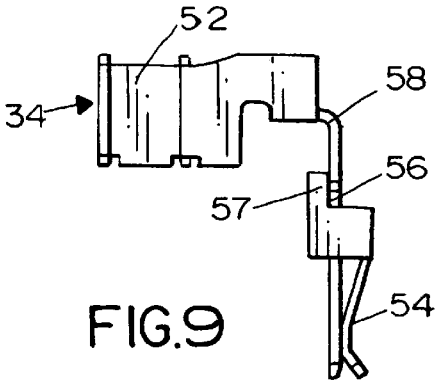
FIG. 9 is a side elevational view of the power terminal in its final bent configuration.
Figure 10:
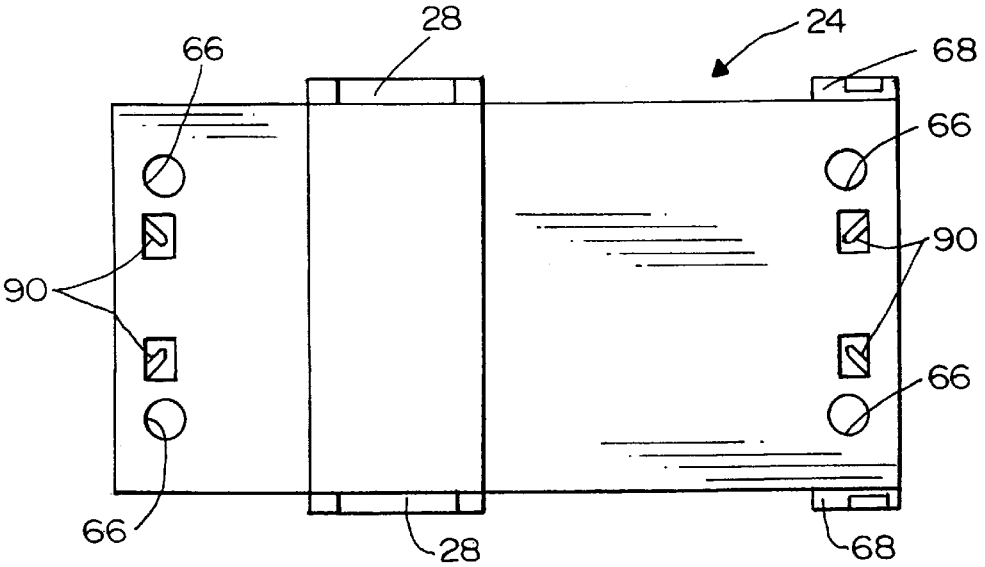
FIG. 10 is a top plan view of the cover.

FIGS. 7–9 show one of the power terminals 34. Each terminal includes an insulation-displacement terminating end 52 and a mating or contact end 54. The terminal is stamped and formed of sheet metal material to a configuration shown in FIG. 7. Insulation displacement end 52 is generally U-shaped to define a pair of generally parallel legs or plates **52*a* having slots 52*b*. One of the insulated power conductor wires of a three-wire electrical cable is terminated into slots 52*b* in the direction of arrow "B" (FIG. 7). Slots 52*b* are of a width to cut through the insulation of the wire and make contact with opposite sides of the conductor of the wire. Contact end 54 is bifurcated to define a pair of opposing contact blades 54*a* for receiving therebetween a power contact of the complementary mating connector. A press-fit projection 56 extends laterally from the terminal. Finally, an intermediate body portion 58 separates terminating end 52 from contact end 54**.

Figure 5:
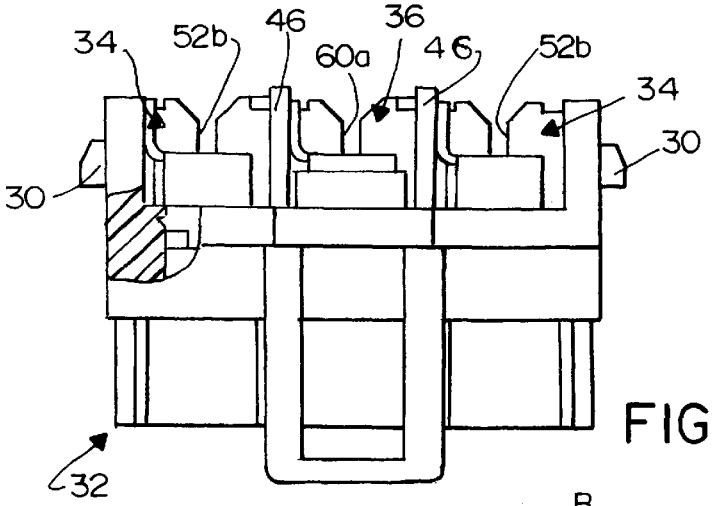
FIG. 5 is an end elevational view of the base assembly looking toward the right-hand end of FIG. 4.

As seen in FIG. 8, contact end 54 of each power terminal 34 is bent in the direction of arrow "C" relative to terminating end 52 such that the terminal has a right-angled configuration as shown in FIG. 9. The contact portion of the terminal then is inserted in the direction of arrow "D" (FIG. 9) into receptacle 50 of base 38 as is seen clearly in FIG. 4. Lateral projection 56 holds the terminal on the base by a press-fit within the receptacle as shown in the partial section view in FIG. 5. Flange 57 as best shown in FIG. 7 prevents the terminal 34 from rotating after assembly maintain terminal parallelism. When the power terminals are mounted on base 22, insulation displacement slots **52*b* face upwardly from bottom wall 38 between side walls 40 as best seen in FIGS. 5 and 6**, for receiving the power conductor wires in the direction of arrows "B".

Center ground terminal 36 is similar to power terminals 34 and will not be described in greater detail except for the fact that the ground terminal includes only one insulation displacement plate. In other words, as seen in FIG. 3, center ground terminal 36 includes only one insulation displacement plate 60 having a slot **60*a* therein, versus the dual plates 52*a* of power terminals 34. Nevertheless, the ground conductor wire of the three-wire electrical cable is similarly terminated in the direction of arrow "E" (FIG. 6) into slot 60*a*** of the ground terminal similar to the termination of the power conductor wires to the power terminals in the direction of arrows "B".

Figure 11:
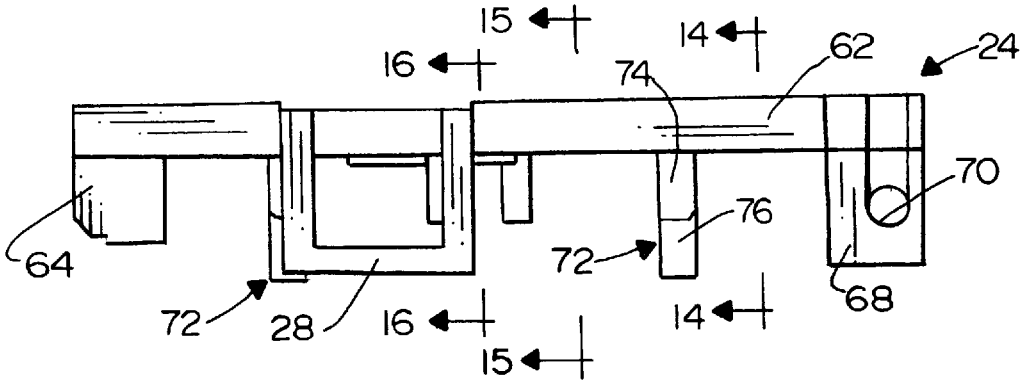
FIG. 11 is a side elevational view of the cover.
Figure 12:
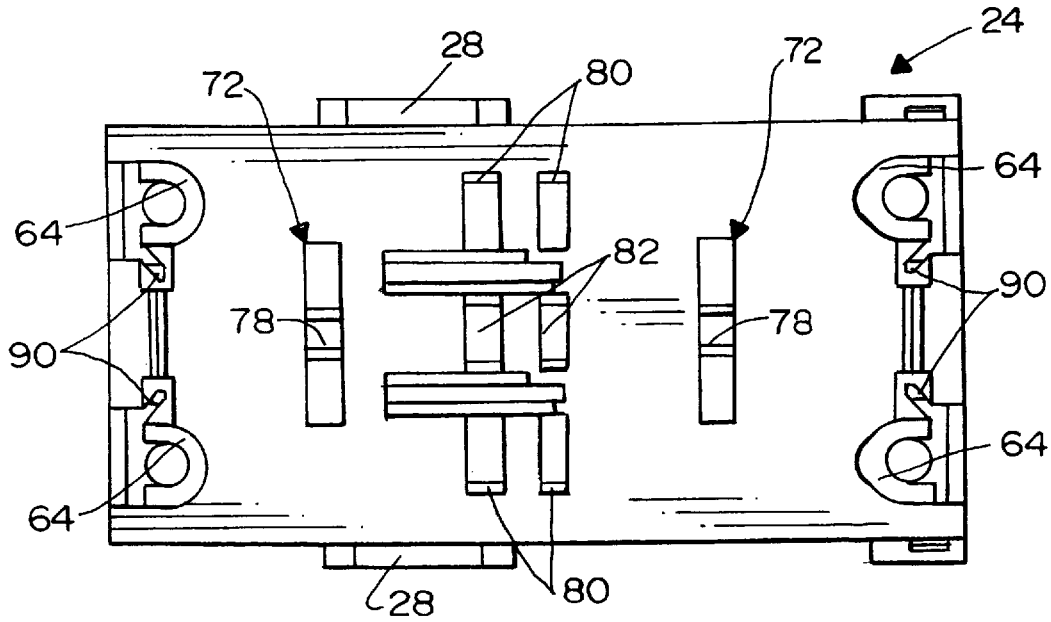
FIG. 12 is a bottom plan view of the cover.

Referring to FIGS. 10–16, cover 24 includes a generally flat cover plate 62 having four fastening bosses 64 depending from the underside thereof as best seen in FIGS. 1, 11 and 12. The fastening bosses have through holes 66 (FIG. 10) which become aligned with holes 44 (FIG. 3) in base 22. Therefore, fasteners can be inserted through bosses 66 and holes 44 to permanently secure the cover to the base and/or secure the entire tap connector to an extraneous supporting structure.

Figure 13:
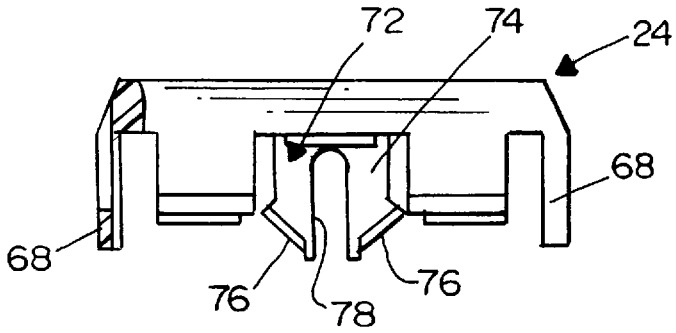
FIG. 13 is an end elevational view of the cover, looking toward the right-hand ends of FIGS. 10–12.
Figure 14:
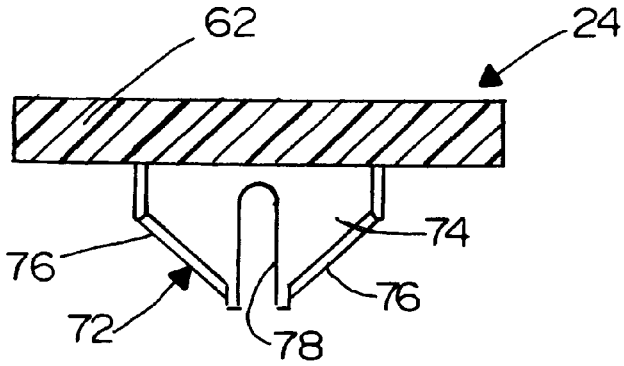
FIG. 14 is a vertical section taken generally along line 14—14 of FIG. 11.

U-shaped latch arms 28 also project from cover plate 62 at opposite sides thereof. In addition, a pair of pivot arms 68 also project from opposite sides of the cover plate as best seen in FIGS. 11 and 13. The pivot arms have holes 70 (FIG. 11) for receiving pivot bosses 42 which project outwardly from base 22 to pivotally mount the cover to the base.

Generally, spreader means, generally designated 72, are provided on the underside of cover plate 62 for engaging the power conductor wires and spreading the power conductor wires into alignment with the laterally spaced power terminals 34. More particularly, as seen best in FIG. 14 in conjunction with FIGS. 11 and 12, each spreader means 72 is defined by a flange 74 which forms a pair of angled edges or surfaces 76 that diverge outwardly and upwardly relative to each other. The angled surfaces are separated by a locating slot 78 which extends into flange 74.

In operation, when cover 24 is pivoted from its open position shown in FIG. 1 to its closed position shown in FIG. 2, angled surfaces 76 engage and spread the power conductor wires of the electrical cable outwardly away from each other and into alignment with the insulation displacement ends 52 and slots **52*b* of power terminals 34. This spreading of the conductor wires is accomplished automatically as the cover is closed onto the base. The ground wire of the three-wire electrical cable moves into locating slot 78 between angled surfaces 76. As seen in FIGS. 11 and 12, a pair of spreader means 72 (i.e. flanges 74**) are spaced longitudinally of the connector for engaging and spreading the wires on opposite sides of the insulation displacement terminals. This maintains the conductor wires generally parallel to the longitudinal axis of the connector in the area of the terminals and ensures good insulation displacement termination.

Figure 15:
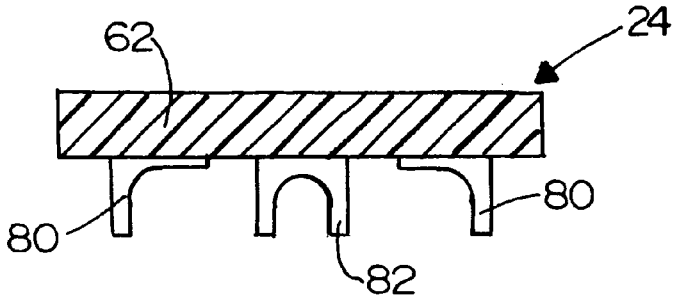
FIG. 15 is a vertical section taken generally along line 15—15 of FIG. 11.
Figure 16:
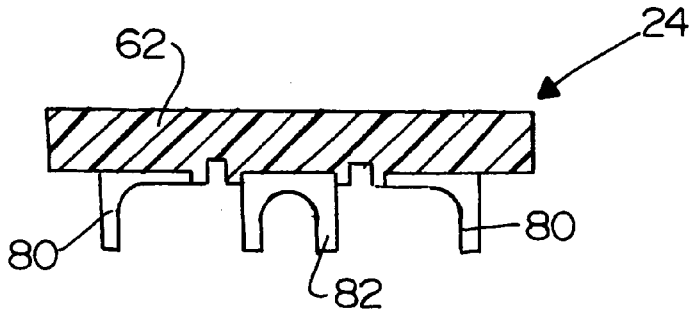
FIG. 16 is a vertical section taken generally along line 16—16 of FIG. 11.

Generally, locating means also are provided for precisely locating the conductor wires for termination into slots 52*b* of power terminals 34 and slot 60*a* of ground terminal 36. More particularly, FIGS. 15 and 16 show outside locating flanges 80 and center locating flanges 82. The outside locating flanges are for the power conductor wires and the center locating flanges are for the ground conductor wire. As seen in FIG. 12, two sets of the outside and inside locating flanges (as seen in FIGS. 15 and 16) are spaced longitudinally of the cover. These sets of locating flanges are in position for straddling the innermost plates 52*a* of power terminals 34 and plate 60 of ground terminal 36 which are all in a transverse line as seen clearly in FIG. 3. Therefore, the locating flanges are effective to precisely locate the conductor wires in alignment with slot 52*b* in plates 52*a* and slot 60*a* in plate 60 during termination.

Figure 17:
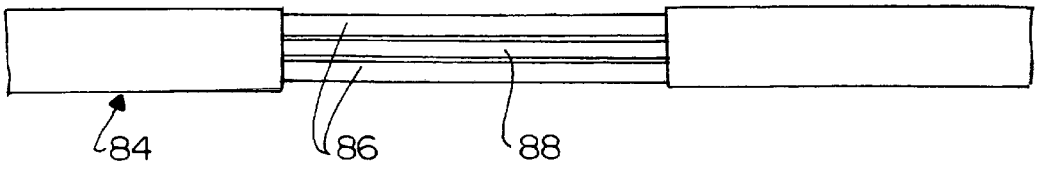
FIG. 17 is a top view of the cable.
Figure 18:
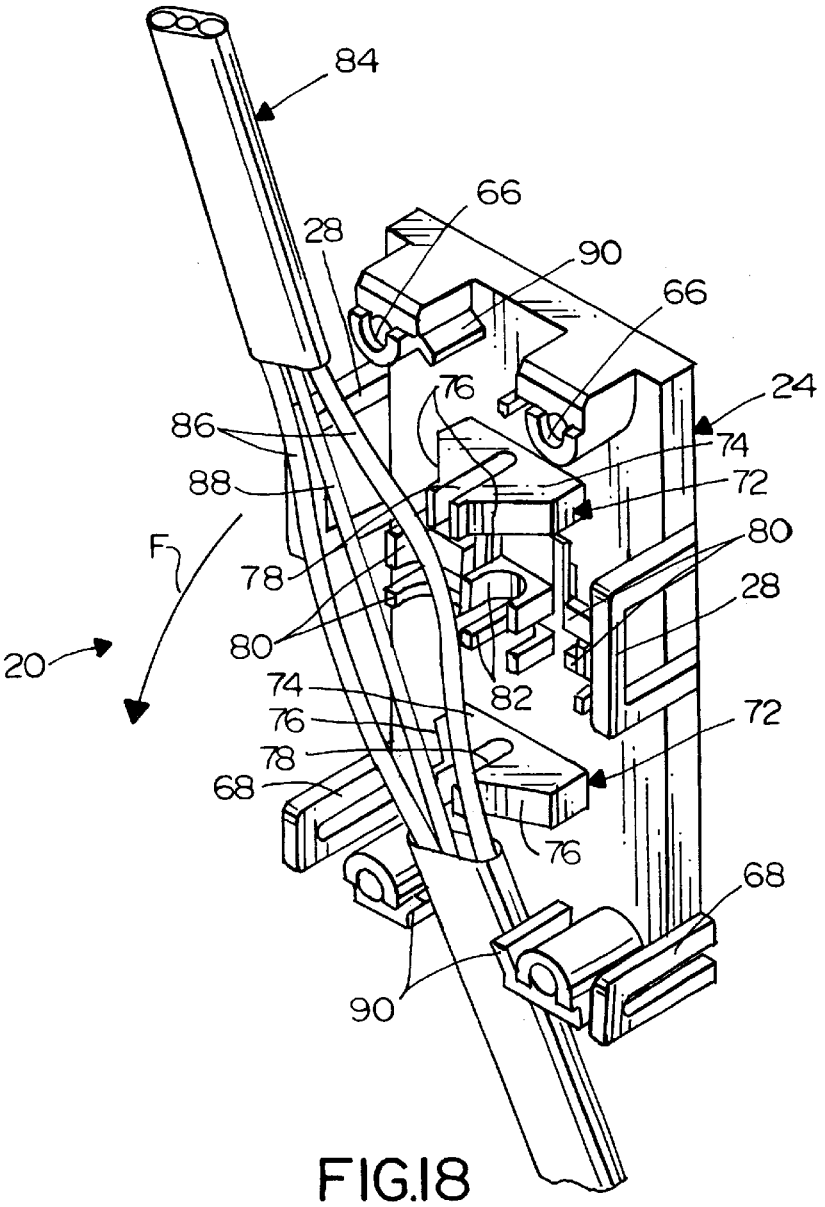
FIG. 18 is a perspective view of the cover with the cable.

In operation, as stated above, base assembly 32 and cover 24 are packaged and shipped together for ultimate use. When a termination is desired, as shown in FIG. 17, the conductor wires of a three-wire electrical cable are prepared by stripping the outer cladding of the cable to expose two insulated conductor wires 86 and one non insulated ground wire 88 over a given length approximately the length of the area within tap connector 20. The prepared cable then is positioned in cover 24 as shown in FIG. 17 with the conductors generally on axis 48 (FIG. 3). The wires are arranged to have the ground wire 88 in the center between the two power wires 86. Cover 24 then is assembled to base assembly 32 by snapping pivot bosses 42 of base 22 into holes 70 of pivot arms 68 of the cover. The cover will be in an open position. The cover then is pivoted in the direction of arrow "F" (FIG. 1) to its closed and locked position as shown in FIG. 2. During closing, angled surfaces 76 of flanges 74 which define spreader means 72 engage the power conductor wires of the cable and spread the power wires laterally outwardly of axis 48 and into alignment with termination ends 52 of power terminals 34. The ground conductor wire of the cable moves into locating slots 78 between angled surfaces 76. As the cover is closed onto the base assembly, the conductor wires of the cable are driven into slots 52*b* and 60*a* of power terminals 34 and ground terminal 36, respectively. Locating flanges 80 and 82 on the underside of cover plate 62 precisely align the conductors with the insulation-displacement slots. Strain relief fingers 90 contact the outer insulation cladding of the cable 84 which helps to prevent axial movement of the connector 20 along the cable 84. Latch arms 28 on the cover and latch bosses 30 on the base hold the tap connector in closed condition terminating the electrical cable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A tap connector for interconnection to an electrical cable having a plurality of conductor wires, comprising:

a base housing part defining a longitudinal axis along which the electrical cable is disposed;

a plurality of insulation displacement terminals on the base housing part spaced laterally of said axis for terminating the conductor wires of the cable;

a cover housing part pivotally mounted on the base housing part for movement between an open position and a closed position whereat the insulated conductor wires are biased into termination with the insulation displacement terminals; and spreader means on the cover housing part for engaging the conductor wires and spreading the wires into alignment with the laterally spaced terminals automatically in response to pivoting the cover housing part from its open position to its closed position.

2. The tap connector of claim 1 wherein said spreader means includes an angled surface for engaging and biasing one of the conductor wires away from another of the conductor wires in response to said pivoting of the cover housing part.

3. The tap connector of claim 2 wherein said spreader means includes a pair of said angled surfaces at opposite angles to bias a pair of the conductor wires away from each other.

4. The tap connector of claim 3, including locating means between said pair of angled surfaces for holding a third conductor wire between said pair of conductor wires.

5. The tap connector of claim 1, including a pair of said spreader means spaced longitudinally on opposite sides of the insulation displacement terminals in a line parallel to the longitudinal axis of the base housing part to maintain the conductor wires generally parallel to the longitudinal axis of the terminals.

6. The tap connector of claim 5, including wire locating means on the cover housing part between said pair of spreader means.

7. The tap connector of claim 1 wherein said base housing part includes a receptacle for a complementary mating connector, the terminals having contact portions in the receptacle for engaging appropriate contacts of the mating connector.

8. The tap connector of claim 7 wherein said receptacle faces generally perpendicular to said longitudinal axis whereby the tap connector has a right-angled configuration.

9. A tap connector for interconnection to an electrical cable having a plurality of conductor wires, comprising:

a base housing part defining a longitudinal axis along which the electrical cable is disposed;

a plurality of insulation displacement terminals on the base housing part spaced laterally of said axis for terminating the conductor wires of the cable;

a cover housing part pivotally mounted on the base housing part for movement between an open position and a closed position whereat the conductor wires are biased into termination with the insulation displacement terminals;

a pair of spreader means on the cover housing part spaced longitudinally on opposite sides of the insulation displacement terminals in a line parallel to the longitudinal axis of the base housing part, the spreader means including a pair of angled surfaces at opposite angles for engaging a pair of conductor wires and spreading the wires away from each other into alignment with a pair of the laterally spaced terminals automatically in response to pivoting the cover housing part from its open position to its closed position; and wire locating means on the cover housing part between said pair of spreader means.

10. The tap connector of claim 9 wherein each of said spreader means includes a locating means between said pair of angled surfaces for holding a third conductor wire between said pair of conductor wires.

11. The tap connector of claim 9 wherein said base housing part includes a receptacle for a complementary mating connector, the terminals having contact portions in the receptacle for engaging appropriate contacts of the mating connector.

12. The tap connector of claim 11 wherein said receptacle faces generally perpendicular to said longitudinal axis whereby the tap connector has a right-angled configuration.

13. A tap connector for interconnection to an electrical cable having a plurality of conductor wires, comprising:

a first part defining a longitudinal axis along which the electrical cable is disposed;

a plurality of terminals spaced on the first part spaced laterally of said axis for terminating the conductor wires of the cable; and a second part mountable on the first part and including spreader means for engaging and spreading the conductor wires automatically in response to mounting the first part on the second part.

14. The tap connector of claim 13 wherein said spreader means includes an angled surface for engaging and biasing one of the conductor wires away from another of the conductor wires in response to mounting said second part on said first part.

15. The tap connector of claim 14 wherein said spreader means includes a pair of said angled surfaces at opposite angles to bias a pair of the conductor wires away from each other.

16. The tap connector of claim 15, including locating means between said pair of angled surfaces for holding a third conductor wire between said pair of conductor wires.

17. The tap connector of claim 13, including a pair of said spreader means spaced longitudinally on opposite sides of the terminals in a line parallel to the longitudinal axis of the base housing part to maintain the conductor wires generally parallel to the longitudinal axis in an area adjacent the terminals.

18. The tap connector of claim 17, including wire locating means on the first part between said pair of spreader means.

* * * * *